United States Patent [19]

Chujo et al.

[11] Patent Number: 4,458,319

[45] Date of Patent: Jul. 3, 1984

[54] METHOD AND APPARATUS FOR CONTROLLING THE AIR-FUEL RATIO IN AN INTERNAL COMBUSTION ENGINE

[75] Inventors: Yoshiki Chujo, Susono; Takehisa Yaegashi, Mishima; Shinichi Sugiyama, Susono, all of Japan

[73] Assignee: Toyota Jidosha Kogyo Kabushiki Kaisha, Toyota, Japan

[21] Appl. No.: 276,995

[22] Filed: Jun. 24, 1981

[30] Foreign Application Priority Data

Jun. 30, 1980 [JP] Japan ..... 55-87918

[51] Int. Cl.[3] ..... F02B 3/04; F02D 35/00; F02M 51/00

[52] U.S. Cl. ..... 364/431.06; 123/440; 123/480; 364/431.05

[58] Field of Search ..... 364/431.05, 431.06; 123/437, 440, 480, 486; 60/276, 285

[56] References Cited

U.S. PATENT DOCUMENTS 4,263,652 4/1981 Henrich ..... 123/440 X
4,290,107 9/1981 Suda et al. ..... 123/440 X
4,314,537 2/1982 Asano et al. ..... 123/440
4,324,218 4/1982 Hattori et al. ..... 123/440
4,345,562 8/1982 Drews et al. ..... 123/440
4,355,615 10/1982 Asano et al. ..... 123/440 X
4,359,029 11/1982 Furuhashi et al. ..... 123/440

*Primary Examiner*—Felix D. Gruber
*Attorney, Agent, or Firm*—Cushman, Darby & Cushman

[57] ABSTRACT

An output voltage from an $O_2$ sensor is intermittently sampled and the sampled voltage is converted into a binary signal. The binary signal is applied to an electrical digital computer, and therein the following operations are carried out. First, the maximum and minimum values of the applied binary signal are detected, then the difference between the detected values is calculated. Thereafter, the calculated difference is compared with a predetermined value to generate a binary signal indicative of the comparison result. The air-fuel ratio feedback control responsive to the applied binary signal is executed when the binary comparison result signal indicates that the calculated difference is larger than or equal to a predetermined value.

14 Claims, 10 Drawing Figures

IS FIRST CALCULATION CYCLE ?
YES
NO
INITIAL VALUES ARE SET
CHANNEL OF O2 SENSOR OUTPUT IS SELECTED
O2 SENSOR OUTPUT IS SUBJECTED TO A/D CONVERSION
Vox IS INPUT
IS F/B EXECUTION FLAG ON ?
IS RICH FLAG ON ?
IS Vox ≧ V'ox ?
V'MAX ← VMAX
IS Vox < A ?
IS Vox < V'ox ?
V'MIN ← VMIN
A ← (VMAX+VR)/2
IS Vox < B ?
VMINO ← Vox
B ← (VMIN + VR)/2
IS Vox ≧ A ?
VMAXO ← Vox
VMAX ← (VMAXO+V'MAX)/2
β ← 1

METHOD AND APPARATUS FOR CONTROLLING THE AIR-FUEL RATIO IN AN INTERNAL COMBUSTION ENGINE

BACKGROUND OF THE INVENTION

The present invention relates to an air-fuel ratio feedback control method of an internal combustion engine, and more specifically to an air-fuel ratio feedback control method using an electrical digital computer.

An internal combustion engine, in general, emits gases containing pollutants such as carbon monoxide (CO), nitrogen (NOx), unburned or partly burned hydrocarbons (HC). When these pollutants are to be cleaned using a three-way catalytic converter, it is required to very precisely control the air-fuel ratio within a range around the stoichiometric air-fuel ratio such that all of the three components, i.e., CO, NOx and HC can be removed effectively.

Therefore, an internal combustion engine employing the above-mentioned three-way catalytic converter usually adopts a method of controlling the feedback of air-fuel ratio responsive to signals from a concentration sensor (exhaust gas sensor) which detects the concentrations of particular components in the exhaust gas. Among many concentration sensors, an oxygen concentration sensor (hereinafter referred to as $O_2$ sensor) for detecting the oxygen concentration has been extensively used for automobiles, such as a stabilized zirconia element or a titania element. When the air-fuel ratio in the atmosphere hovers around 14.5 (stoichiometric air-fuel ratio), the $O_2$ sensor of this type exhibits suddenly changed electric properties. In other words, the $O_2$ sensor detects the changes in the air-fuel ratio causing the electric signals thereof to change.

The $O_2$ sensors, however, have undesirable characteristics in that the output voltage thereof greatly varies in response to a change in the temperature. The internal resistance of the $O_2$ sensors and the electromotive force of the zirconia type $O_2$ sensors exhibit great variation in temperature characteristics. Particularly, at low temperatures, since the internal resistance greatly increases, the $O_2$ sensors become inactive and in this inactive condition the feedback control operation initiated in response to the output voltage of the $O_2$ sensors cannot be executed. Therefore, in conventional air-fuel ratio control methods, the coolant temperature is always monitored, and if the coolant temperature becomes lower than a predetermined temperature, the feedback control (closed-loop control) of the air-fuel ratio is forcibly inhibited from executing and an open-loop control of the air-fuel ratio is begun.

In the above-mentioned conventional method, the coolant temperature is used for recognizing whether the $O_2$ sensor is active or inactive. According to such a conventional method, when the coolant temperature sensor malfunctions, even when the $O_2$ sensor is active, no air-fuel ratio feedback control is executed, or even when the $O_2$ sensor is inactive, the air-fuel ratio feedback control is carried out in response to a false signal from the $O_2$ sensor. Furthermore, according to the conventional method, since precise judgement whether the $O_2$ sensor is active or not cannot be expected, the operative temperature range wherein the $O_2$ sensor is active is restricted to a very small range. This is a serious problem for present day internal combustion engines whose exhaust gas temperature is controlled to be low, because in such engines, the $O_2$ sensor must be operated under a low temperature condition in which it is considered to be inactive.

SUMMARY OF THE INVENTION

It is, therefore, an object of the present invention to provide an air-fuel ratio control method and apparatus which is capable of precisely recognizing an operative temperature range wherein the $O_2$ sensor is active, and thus which can precisely control the air-fuel ratio under a wide temperature range.

According to the present invention, an air-fuel ratio control method comprises the steps of: intermittently sampling a voltage signal from an exhaust gas sensor which detects the concentration of a predetermined component in the exhaust gas and converting the sampled voltage signal into an electrical signal in the form of a binary number; applying the converted binary signal to an electrical digital computer; detecting the maximum value and the minimum value of the applied binary signal and calculating the difference between the detected maximum and minimum values, by means of a digital computer; comparing by means of the digital computer, the calculated difference with a predetermined value to obtain a binary signal which indicates the comparison result; and feedback-controlling the air-fuel ratio of the engine in response to the applied binary signal, the controlling is executed when the binary comparison result signal indicates that the calculated difference is larger than or equal to the predetermined value.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
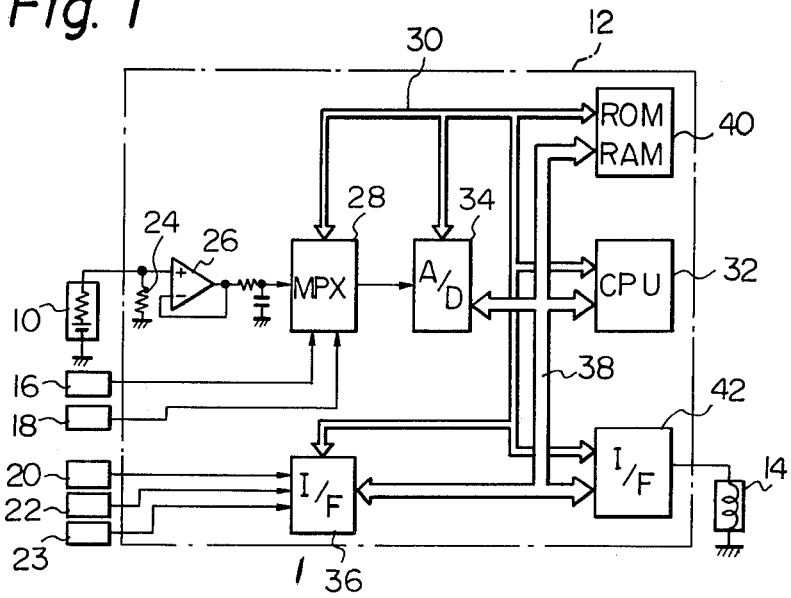
FIG. 1 is a block diagram schematically illustrating an embodiment of the present invention.

FIG. 1 is a block diagram illustrating an embodiment according to the present invention, which employs a stabilized zirconia element as an $O_2$ sensor. Namely, the device of this embodiment controls the air-fuel ratio by adjusting the amount of fuel supplied from a fuel injection valve responsive to the output voltage of the $O_2$ sensor. In FIG. 1, reference numeral 10 denotes the above-mentioned $O_2$ sensor, 12 denotes a control circuit including an electrical digital computer, and 14 denotes a fuel injection valve. In addition to signals from the $O_2$ sensor, the control circuit 12 is served with signals from an air-flow sensor 16, a coolant-temperature sensor 18, a running-speed sensor 20, a throttle position switch 22 and a starter motor 23.

The output voltage of the $O_2$ sensor is applied to an analog multiplexer 28 via a parallel resistor 24 having a resistance of several megohms and a buffer amplifier 26. The analog multiplexer 28 further receives voltage signals representing the amount of air introduced into the engine from the air-flow sensor 16, voltage signals representing the temperature of the coolant from the coolant-temperature sensor 18, and various other analog signals that represent the operation condition of the engine. These analog voltage signals are fed in a time divisional manner to an analog-to-digital converter (A/D converter) 34 owing to control signals that are fed from a central processing unit (CPU) 32 through a control bus 30, and are successively converted into electrical signals in the form of a binary number.

An input interface 36 is served with binary signals that represent the running speed of the engine produced by the running-speed sensor 20, with signals that represent the opening state of a throttle valve (not shown) produced by the throttle position switch 22, and with signals that represent the engine being started produced by the starter motor 23.

The A/D converter 34 and the input interface 36 are connected, via a data bus 38, to the CPU 32, to a memory 40 consisting of a read-only memory (ROM) and a random access memory (RAM), and to an output interface 42. The ROM in the memory 40 preliminarily stores a control program of the digital computer, a variety of operation constants which have been determined beforehand by experiments, and initial values. The output interface 42 receives a value related to the fuel injection time that is calculated by the CPU 32, converts the value into a binary (pulse) signal having a variable pulse width and sends it to a fuel injection valve (or valves) 14. Therefore, the opening time of the injection valve 14 is controlled, the amount of fuel injection is controlled, and the feedback of the air-fuel ratio is controlled.

Figure 2:
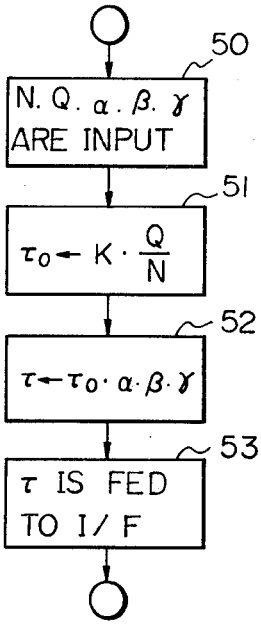
FIGS. 2, 3A, 3B and 4 are flow charts of parts of control programs in the embodiment of FIG. 1.

It is widely known to arithmetically determine the fuel injection time with a digital computer in accordance with operating conditions. For example, the arithmetic operation is carried out according to a flow chart as schematically illustrated in FIG. 2, although its details are not mentioned here. The CPU 32 executes the arithmetic operation as shown in FIG. 2 responsive to every predetermined crank angle or request of interrupt at every predetermined period of time. At a point 50, first, the CPU 32 takes out, from the RAM, the data N related to the running speed, the data Q related to the amount of air taken in, the correction factor $\alpha$ of the water temperature, the correction factor $\beta$ related to the feedback of the air-fuel ratio, and the correction factor $\gamma$ related to another engine parameter. These data N and Q have already been obtained from the sensors 16 and 20, and are temporarily stored in the RAM. Further, the correction factor $\alpha$ is calculated beforehand is responsive to water-temperature signals from the sensors 18, and is temporarily stored in the RAM. The correction factor $\beta$ is calculated by the method of the present invention, as will be mentioned below, and is temporarily stored in the RAM. The correction factor $\gamma$ is related to an acceleration increment of fuel, determined in response to a signal from the throttle position switch 22, and temporarily stored in the RAM.

Then, an arithmetic calculation of $\tau_0=K\cdot(Q/N)$ is carried out at a point 51, and an operation for correction $\tau=\tau_0\cdot\alpha\cdot\beta\cdot\gamma$ is carried out at a point 52. Here, K represents a constant. The thus calculated value $\tau$ is then fed to the output interface 42, as a fuel injection time.

Figures 3, 3A, 3B:
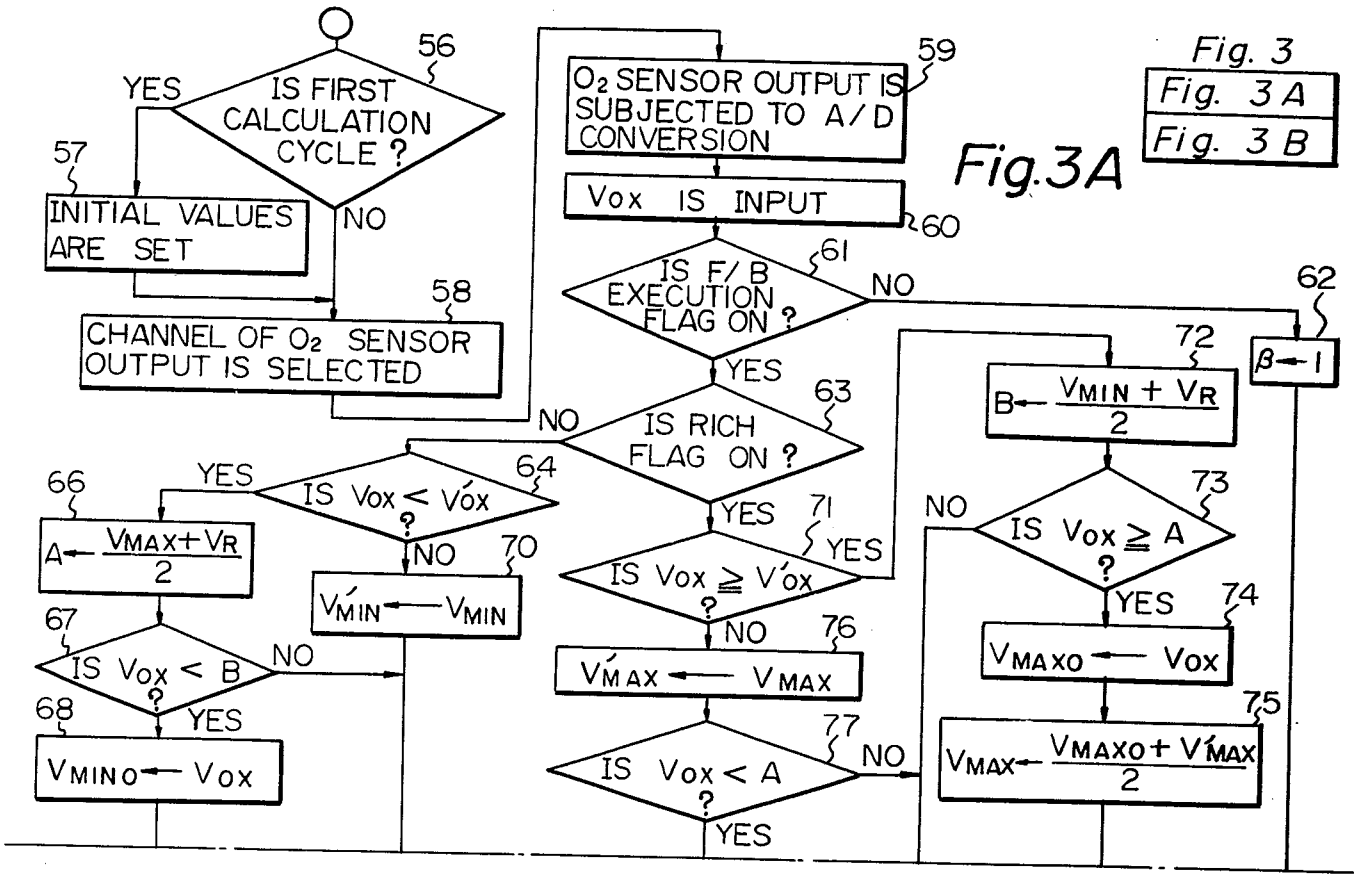
Figure 3B:
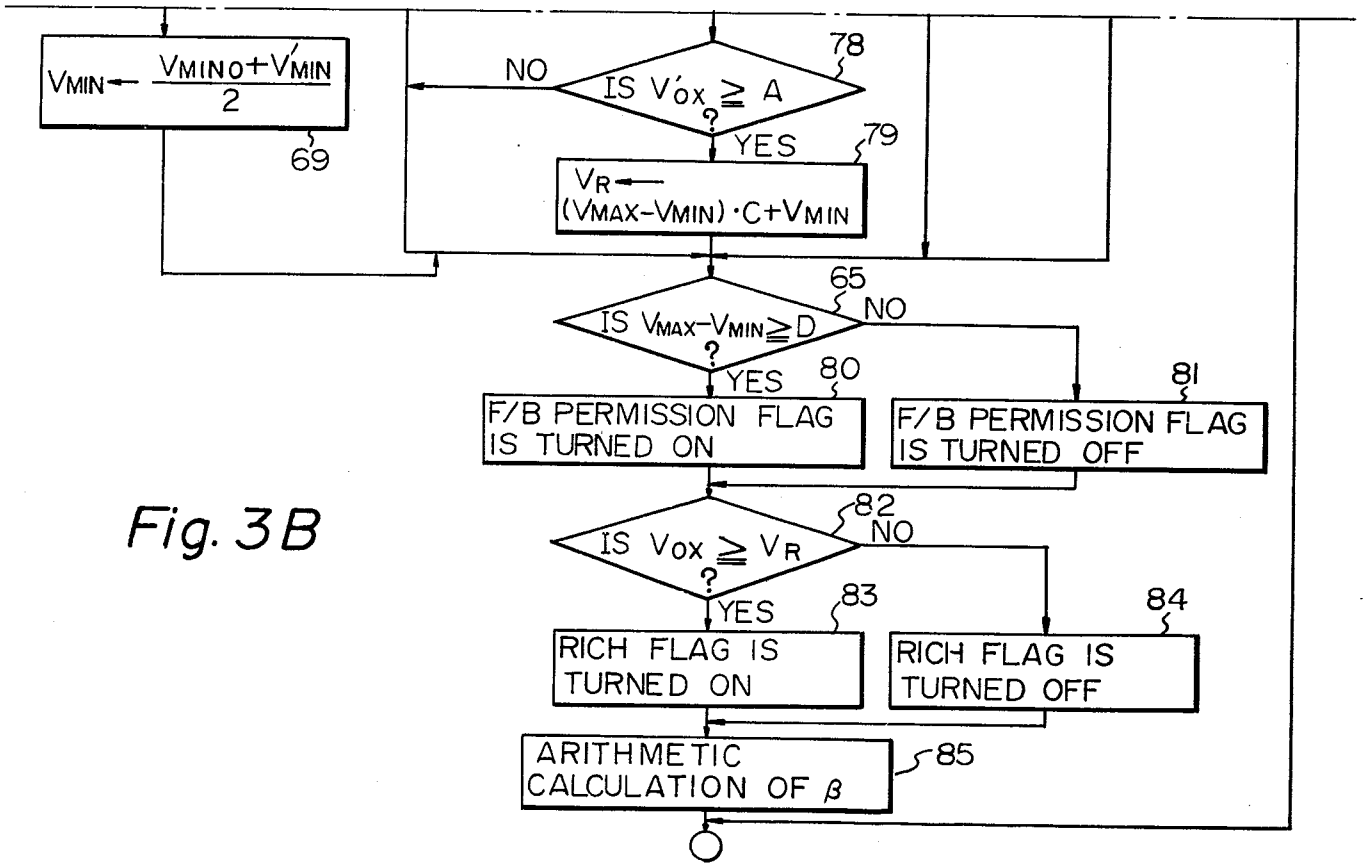

FIGS. 3A and B illustrate a routine for calculating the above-mentioned correction factor $\beta$. The operation of the embodiment will be mentioned below in detail with reference to FIGS. 3A and B.

The CPU 32 executes the routine shown in FIG. 3 at every predetermined period of time, for example, at every 4 to 8 msec. At a point 56, at first, the CPU 32 discriminates whether the present cycle is a first calculation cycle after the engine starts to operate or not. If it is the first calculation cycle, initial values of $V_{MAX}$, $V_{MIN}$, $V'_{MAX}$, $V'_{MIN}$, $V'_{OX}$ and $V_R$ are set at a point 57. Then, at a point 58, the CPU 32 instructs the multiplexer 28 to select the channel of the $O_2$ sensor 10, and at a point 59, the CPU 32 instructs the A/D converter 34 to subject the output voltage of the $O_2$ sensor 10 to the A/D conversion. At a point 60, thereafter, an output voltage data $V_{OX}$ of the $O_2$ sensor which is converted into a binary signal is introduced. At the next point 61, the CPU 34 discriminates whether a F/B execution flag is on or not. If the F/B execution flag is off, the program proceeds to a point 62. At the point 62, the correction factor $\beta$ is fixed to 1.0, namely the operation of $\beta\leftarrow 1.0$ is executed, and then, the fixed correction factor $\beta$ is stored in the RAM of the memory 40. Thereafter, the calculation cycle of the routine of FIG. 3 is finished. In case that the correction factor $\beta$ is fixed to 1.0, the feedback control (closed-loop control) of the air-fuel ratio is response to the output voltage from the $O_2$ sensor is stopped, as apparent from the calculation at the point 52 of FIG. 2.

If the F/B execution flag is on, the program proceeds to a point 63, and where the CPU 32 descriminates whether the rich flag is on or off. The rich flag will have been set to on or off in the previous cycle of arithmetic operation. When the rich flag is off, i.e., when the input data $V_{OX}$ is smaller than a reference value in the previous cycle of arithmetic operation, and the engine is in the lean condition, the program proceeds to a point 64 where the input data $V'_{OX}$ in the previous cycle is compared with the input data $V_{OX}$ of this time with regard to their magnitude. The comparison at the point 64 is to discriminate whether the output voltage of the $O_2$ sensor 10 is increasing or decreasing. When $V_{OX}\geqq V'_{OX}$, the program proceeds, via a point 70, to a point 65 where the difference between the maximum value $V_{MAX}$ and the minimum value $V_{MIN}$ of the input data $V_{OX}$ is compared with a predetermined value D. When $V_{OX}<V'_{OX}$ i.e., when the engine is in the lean condition and when the output voltage of the $O_2$ sensor 10 is decreasing, the program proceeds to a point 66 where a setpoint value A, which is used for calculating a maximum value of the input data $V_{OX}$, is found from a relation of $$A=(V_{MAX}+V_R)/2$$

Here, $V_{MAX}$ and $V_R$ represent a maximum value in the input data $V_{OX}$ determined in the previous or earlier cycle of arithmetic operation, and a reference value, respectively. Then, at a point 67, the CPU 32 discriminates whether the input data $V_{OX}$ is greater than a setpoint value B or not. When $V_{OX}\geqq B$, the program proceeds to the above-mentioned point 65. Only when $V_{OX}<B$, the program proceeds to routines of points 68 and 69 where a minimum value $V_{MIN}$ is renewed. Namely, $V_{MINO}$ is set equal to $V_{OX}$ at the point 68, and calculation of $$V_{MIN}=(V_{MINO}+V'_{MIN})/2$$

is performed at the point 69. Here, $V'_{MIN}$ represents a minimum value $V_{MIN}$ calculated previously. When $V_{OX} \geqq V'_{OX}$ at the point 64, i.e., when the engine is in the lean condition and when the output voltage is increased, the minimum value $V_{MIN}$ obtained the last calculation cycle passing through the point 69 is stored as $V'_{MIN}$ in the RAM of the memory 40 at the point 70. Then, the program proceeds to the point 65.

If at the point 63, the CPU 32 so discriminates that the rich flag is on, the program proceeds to a point 71 where the previous input data $V'_{OX}$ is compared with the input data $V_{OX}$ of this time with regard to their magnitude. When $V_{OX} \geqq V'_{OX}$, the program proceeds to a point 72. Namely, when it is so discriminated that the engine is in the rich condition while the output voltage of the $O_2$ sensor 10 is rising or remains fixed, the program proceeds to a point 72 where a setpoint value B used in the above-mentioned point 67 is calculated from $$B=(V_{MIN}+V_R)/2$$

At a point 73, the CPU 32 discriminates whether the input data $V_{OX}$ is greater than, or equal to, the setpoint value A that is found in the point 66. When $V_{OX}<A$, the program proceeds to the point 65: Only when $V_{OX} \geqq A$, the program proceeds to the routines of points 74, 75 to renew the maximum value $V_{MAX}$. Namely, $V_{MAXO}$ is equalized to $V_{OX}$ at the point 74, and calculation of $$V_{MAX}=(V_{MAXO}+V'_{MAX})/2$$

is performed at the point 75 to find the maximum value $V_{MAX}$. The program then proceeds to the point 65. Here, $V'_{MAX}$ is equal to the maximum value $V_{MAX}$ which was calculated in the previous cycle.

When it is so discriminated that $V_{OX}<V'_{OX}$ at the point 71, i.e., when it is discriminated that the engine is in the rich condition and the output voltage of the $O_2$ sensor 10 is decreasing, the program proceeds to a point 77 via a point 76 where the maximum value $V_{MAX}$ finally calculated is stored as $V'_{MAX}$ in the RAM of the memory 40. At points 77 and 78, the input data $V_{OX}$ of this time and the input data $V'_{OX}$ of the previous operation cycle are compared with the setpoint value A. The program proceeds to the point 79 only when $V'_{OX} \geqq A$ and $V_{OX}<A$. The program proceeds to the point 65 in other cases. At the point 79, the reference value $V_R$ for comparison is renewed according operation constant.

At the point 65, whether the difference between the maximum value $V_{MAX}$ and the minimum value $V_{MIN}$ is greater than (or equal to) the predetermined value D or not is discriminated. If $V_{MAX}-V_{MIN} \geqq D$, it is judged that the $O_2$ sensor 10 is active and an F/B permission flag is turned on at a point 80. Contrary to this, if $V_{MAX}-V_{MIN}<D$, it is judged that the $O_2$ sensor 10 is inactive and the F/B permission flag is turned off at a point 81. This F/B permission flag is used to discriminate whether the F/B execution flag should be turned on or not in an interruption processing routine which will be explained later.

The program, then, proceeds to a point 82 where the input data $V_{OX}$ is compared with the reference value $V_R$ with regard to their magnitude. When $V_{OX} \leqq V_R$, the program proceeds to a point 80 where the rich flag is turned on. When $V_{OX}<V_R$, the program proceeds to a point 84 where the rich flag is turned off.

At the next point 85, the correction factor $\beta$ related to the feedback of the air-fuel ratio is calculated depending upon the on or off of the rich flag. When the rich flag is on, the correction factor $\beta$ is reduced by a predetermined value for each operation cycle. When the rich flag is off, the correction factor $\beta$ is increased by a predetermined value for each operation cycle. Further, when the rich flag is on in the previous operation cycle, but is off in the operation cycle of this time, or when the rich flag is off in the operation cycle of the previous time, but is on in the operation cycle of this time, the processing (skip processing) may be so effected that the correction factor $\beta$ is greatly increased or decreased in the operation cycle of this time. The thus prepared correction factor $\beta$ is stored in the RAM of the memory 40.

Figure 4:
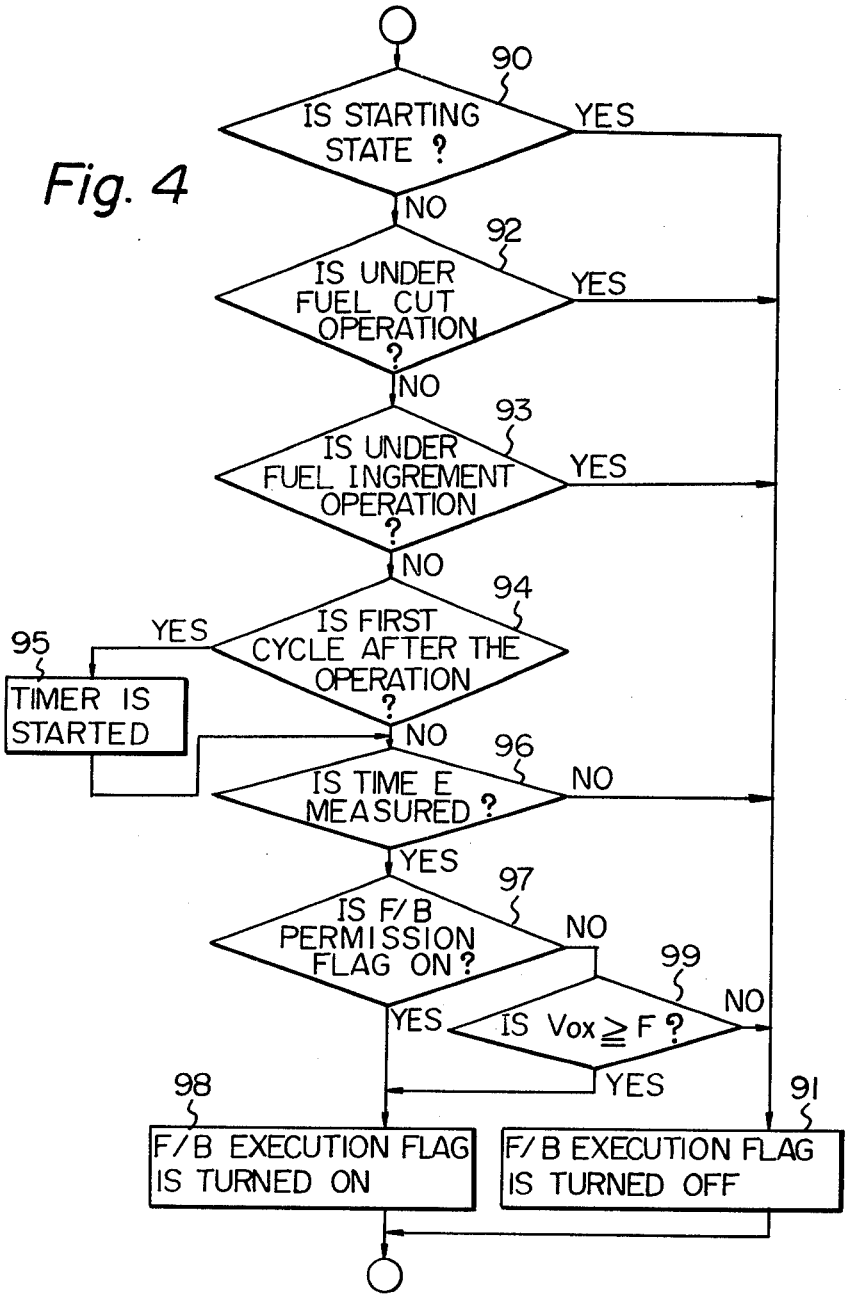

FIG. 4 is a flow chart of an interruption processing routine for controlling the F/B execution flag. The CPU 32 interrupts the operation of the main routine of FIG. 3 and executes the operation of the interruption routine of FIG. 4 in response to an interruption requiring a signal which appears at every predetermined period of time, for example, at every 12.8 msec. At a point 90, first, the CPU 32 discriminates whether the starter motor 23 is energized or not, in other words, whether the engine is under the starting state or not. If it is under the starting state, the program jumps to a point 91 where the F/B execution flag is turned off, and then the program returns to the main routine. During the starting state, since the F/B execution flag is thus turned off, the program in the main routine, proceeds from the point 61 to the point 62 inhibiting the feedback control of the air-fuel ratio.

Contrary to this, if the engine is not under the starting state, the program proceeds to a point 92 where the CPU 32 discriminates whether the engine is under fuel cut operation or not. If under fuel cut operation, the program jumps to the point 91 to turn off the F/B execution flag causing the feedback control of the air-fuel ratio to be stopped. If no fuel cut operation is executed, the program proceeds to a point 93 where whether the engine is under the fuel increment operation or not is discriminated. If it is judged that the fuel increment operation according to the signal from the throttle position switch 22 is now executed, the F/B execution flag is turned off at the point 91. This is because during the fuel increment operation caused by, for example, acceleration, the feedback control operation of the air-fuel ratio should be stopped. If it is not under the fuel increment operation, the program proceeds to a point 94. At the point 94, the CPU 32 discriminates whether or not the present interruption cycle is the first interruption cycle after the fuel cut operation or after the fuel increment operation. If the first interruption cycle, the program proceeds to a point 95 where a timer is started to measure the lapse of time after the fuel cut operation or after the fuel increment operation, and then, proceeds to a point 96. If it is not the first interruption cycle, the program directly proceeds to the point 96. At the point 96, the CPU 32 discriminates whether or not the measured lapse of time exceeds a predetermined period E of time. If the lapse time is shorter than the period E, the program proceeds to the point 91 where the F/B execution flag is turned off. Contrary to this, when the lapse time exceeds the period E, the program proceeds to a point 97.

The above-mentioned processing routine from the point 94 to the point 96 operates to delay the start of the feedback control by a predetermined period of time after the fuel cut operation or after the fuel increment operation in order to precisely control the air-fuel ratio. Since the output voltage of the $O_2$ sensor 10 is fixed to the minimum value during the fuel cut operation or to the maximum value during the fuel increment operation, the reference value $V_R$ extremely deviates if the value $V_R$ is calculated just after the fuel cut operation or the fuel increment operation. If the calculated reference value $V_R$ deviates, the air-fuel ratio will be controlled to a quite wrong value causing the purifying effectiveness of the three-way catalytic converter to greatly reduce and also causing the temperature of the exhaust gas to extraordinarily increase. Therefore, according to the processing routine of points 94 to 96, the start of the feedback control is delayed by a predetermined period of time after the fuel cut or fuel increment operation. The above-mentioned period E is determined in accordance with a delay time of the feedback control, which delay time includes a delay in passing the combustion gas from an intake system to an exhaust system of the engine and a response delay of the $O_2$ sensor.

At the point 97, the CPU 32 discriminates whether the F/B permission flag which is controlled at the point 80 or 81 of the main routine is on or not. If the F/B permission flag is on, the program proceeds to the point 98 where the F/B execution flag is turned on, and then the program returns to the main routine. As a result, in the main routine, the program proceeds from the point 61 to the point 63, so that the feedback control of the air-fuel ratio is carried out.

If it is judged that the F/B permission flag is off at the point 97, the program proceeds to a point 99 where whether or not the input data $V_{OX}$ which corresponds to the output voltage of the $O_2$ sensor 10 is greater than or equal to a predetermined value F is discriminated. If $V_{OX} \geqq F$, the F/B execution flag is turned on at a point 98. On the contrary, if $V_{OX} < F$, the F/B execution flag is turned off at the point 91.

In the processing routine of the points 65, 80 and 81, the F/B permission flag is controlled to turn on or to turn off in accordance with judgement whether or not the difference between the maximum value $V_{MAX}$ and the minimum value $V_{MIN}$ is larger than or equal to a predetermined value D. In other words, the F/B permission flag is turned on when the amplitude of the output voltage of the $O_2$ sensor 10 exceeds a predetermined value. When the amplitude is smaller than the predetermined value, this F/B permission flag is turned off. Generally, in case that the F/B permission flag is off, the F/B execution flag is turned off causing the feedback control operation to be stopped. However, if it is recognized at a point 99 that the output voltage of the $O_2$ sensor 10 increases owing to the change in the operating condition of the engine, which change is followed by increasing the temperature of the exhaust gas, and that the output voltage exceeds a predetermined value F, the F/B execution flag is turned on causing the feedback control operation to be carried out.

Figure 5:
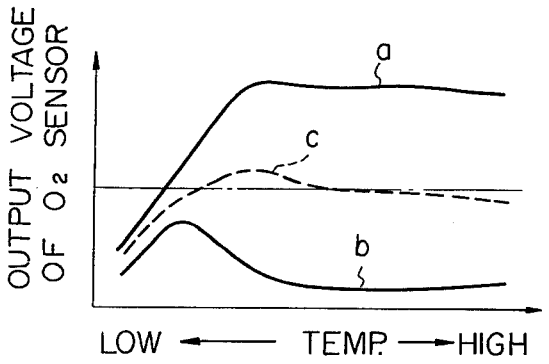
FIGS. 5 and 6 illustrate characteristics of the output voltages from the $O_2$ sensors with respect to the surrounding temperature.

FIG. 5 illustrates output voltage characteristics of an $O_2$ sensor employing a stabilized zirconia element, with respect to the temperature of the $O_2$ sensor. In FIG. 5, solid lines a and b represent maximum output voltages characteristic and minimum output voltage characteristics with respect to the temperature of the $O_2$ sensor, respectively. As it is apparent from FIG. 5, difference between the maximum and minimum values of the output voltage of the zirconia type $O_2$ sensor, in other words, the amplitude of the output voltage of the zirconia type $O_2$ sensor, increases corresponding to the increment of the temperature thereof. Namely, the amplitude of the output voltage of the $O_2$ sensor indicates whether the $O_2$ sensor is active or not. Therefore, if the air-fuel ratio feedback control is stopped when the amplitude is smaller than a predetermined value D and if the feedback control is carried out when the amplitude is larger than or equal to the value D, an operative temperature range wherein the $O_2$ sensor is active can be precisely and reliably recognized. As a result, the temperature range wherein the air-fuel ratio can be precisely controlled becomes very wide.

Figure 6:
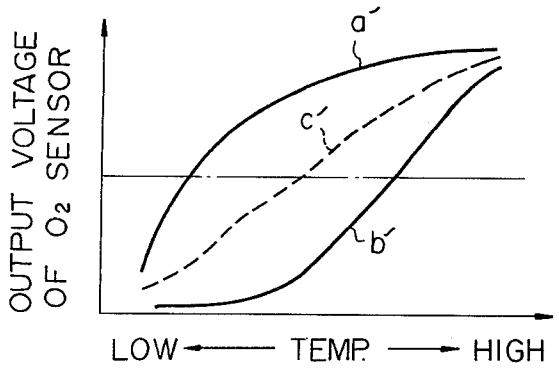

FIG. 6 illustrates output voltage characteristics of an $O_2$ sensor employing a semiconductor element such as a titania element, with respect to the temperature of the $O_2$ sensor. In FIG. 6, solid lines a' and b' represent maximum output voltage characteristics and minimum output voltage characteristics with respect to the temperature, respectively. The operation and effect of an embodiment which employs a semiconductor type $O_2$ sensor as illustrated in FIG. 6 are the same as that of the above-mentioned embodiment which employs a zirconia type $O_2$ sensor.

In the aforementioned processing routine of FIG. 3, the maximum value $V_{MAX}$ is found as an average value of the previous maximum value $V'_{MAX}$ and the maximum value $VA_{MAXO}$ of this time, and the minimum value $V_{MIN}$ is also found as an average value of the previous minimum value $V'_{MIN}$ and the minimum value $V_{MINO}$ of this time. This is executed in order to slow the degree of change in the maximum value and in the minimum value. According to the present invention, however, it is also allowable to utilize the maximum value $V_{MAXO}$ and the minimum value $V_{MINO}$ of this time as the maximum value $V_{MAX}$ and the minimum value $V_{MIN}$, respectively, or to utilize an average value of maximum values in the past two or more times as the maximum value and an average value of minimum values in the past two or more times as the minimum value.

According to the above-mentioned embodiment, the reference value $V_R$ for comparison is set to a value that is obtained by dividing the thus found maximum and minimum values $V_{MAX}$ and $V_{MIN}$ by a predetermined constant C. Therefore, the reference value $V_R$ changes in accordance with the differences of the $O_2$ sensors or with varied output characteristics of the $O_2$ sensor depending upon the temperature, as indicated by the broken line c in FIG. 5 or by the broken line c' in FIG. 6. Accordingly, the comparison and discrimination of the $O_2$ sensor's output are always performed in the vicinity of the stoichiometric air-fuel ratio, and thus the air-fuel ratio can be controlled with high precision.

Since the reference value is changed in response to the temperature characteristics of the $O_2$ sensor as aforementioned, and furthermore, judgment whether the feedback control be executed or not is carried out in accordance with the amplitude of the $O_2$ sensor's output, the temperature range in which the air-fuel ratio feedback control can be performed is extremely widened. In particular, it is very desirable from the standpoint of a future tendency toward lowering the exhaust gas temperature of the internal combustion engines to heighten the energy efficiency that the air-fuel ratio feedback control can be performed at temperatures lower than 400° C.

Figure 7:
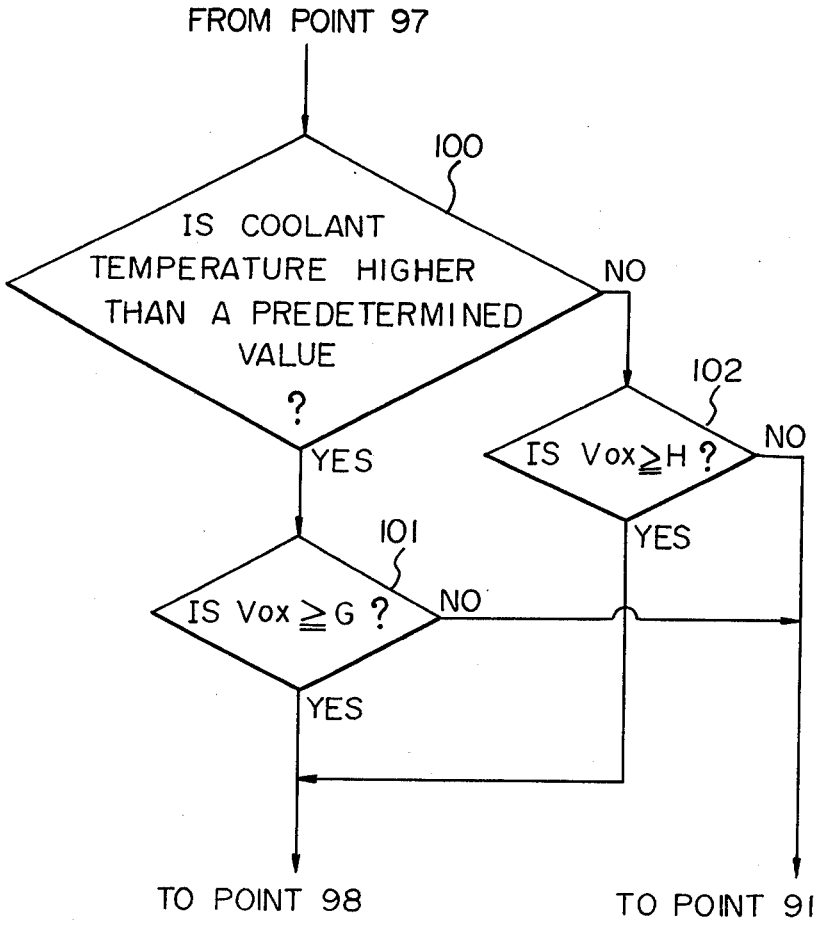
FIGS. 7, 8 and 9 are partial flow charts of modifications of the control program in FIG. 4, respectively.

FIG. 7 illustrates a portion of a processing routine according to an another embodiment of the interruption processing routine shown in FIG. 4. The processing routine of FIG. 7 is carried out instead of the point 99 of FIG. 4. Therefore, other processings of this embodiment are quite the same as those of FIG. 4. In this embodiment, the CPU 32 discriminates whether or not the coolant temperature is higher than or equal to a predetermined value, at a point 100. If it is higher than or equal to the predetermined value, the program proceeds to a point 101, and if not, the program proceeds to a point 102. At the point 101, the input data $V_{OX}$ corresponding to the output voltage of the $O_2$ sensor 10 is compared with a predetermined constant G. If $V_{OX} \geqq G$, the program proceeds to the point 98 where the F/B execution flag is turned on. Contrary to this, if $V_{OX} < G$, the F/B execution flag is turned off at the point 91. At the point 102, the input data Vox is compared with a predetermined constant H. If $V_{OX} \geqq H$, the program proceeds to the point 98 where the F/B execution flag is turned on. Contrary to this, if $V_{OX} < H$, the F/B execution flag is turned off at the point 91. Namely, according to this embodiment of FIG. 7, the constants G and H, which are used for comparing with the input data $V_{OX}$ so as to turn on or off the F/B execution flag, are selectively determined in accordance with the coolant temperature. The relationship between the constants is $G \leqq H$. This processing routine of FIG. 7 is applied to the circuit of FIG. 1 wherein the output voltage of the $O_2$ sensor is derived via the resistance 24 connected in parallel with the $O_2$ sensor 10. However, in case that the output voltage of the $O_2$ sensor is directly derived across the $O_2$ sensor 10 without using the resistance 24, the discrimination at the point 101 is changed to whether $V_{OX} \leqq I$ or not and the discrimination at the point 102 is changed to whether $V_{OX} \leqq J$ or not. The relationship between the constants I and J is $I \leqq J$.

Figure 8:
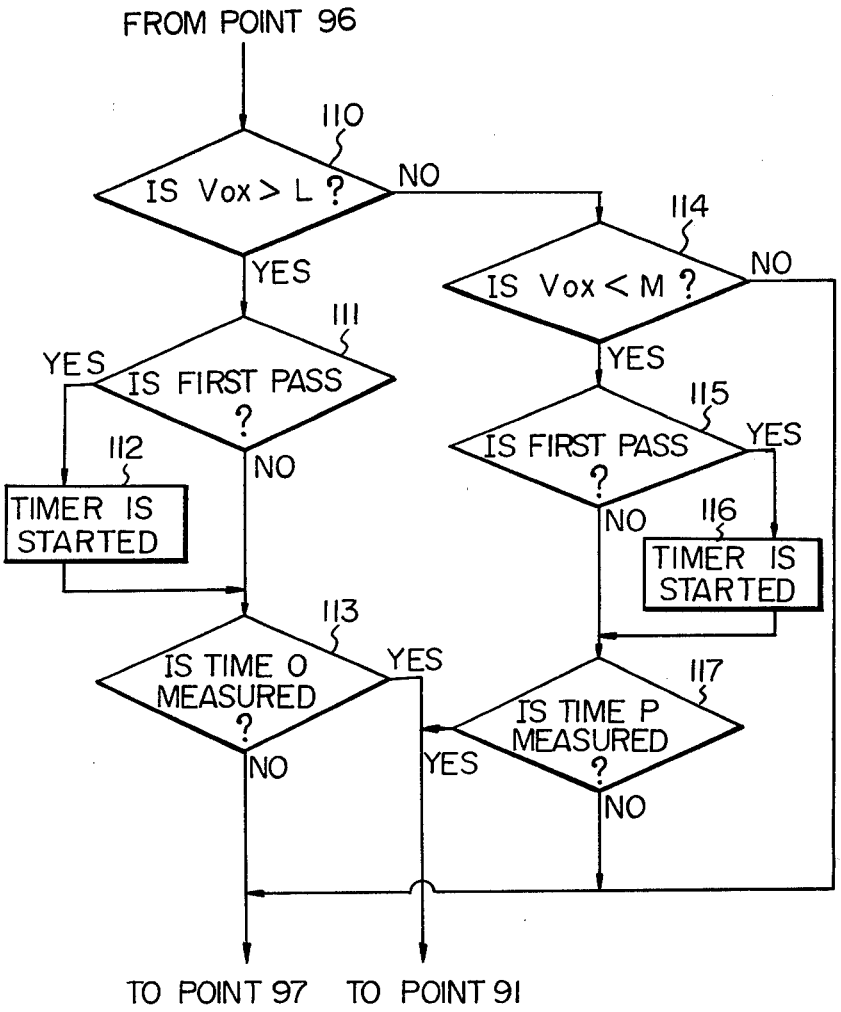

FIG. 8 illustrates a portion of a processing routine according to a further embodiment of the interruption processing routine shown in FIG. 4. The processing routine of FIG. 8 is inserted between the points 96 and 97 of FIG. 4. Therefore, other processings of this embodiment are quite the same as those of FIG. 4. After the lapse of time E is measured at the point 96, the program proceeds to a point 110 where the input data $V_{OX}$ corresponding to the output voltage of the $O_2$ sensor 10 is compared with a predetermined constant L. If $V_{OX} = L$, the program proceeds to a processing routine of points 111 to 113. In this processing routine of the points 111 to 113, it is discriminated that whether the shaft of $V_{OX} > L$ continuously lasts longer than a predetermined period O of time or not. Only when the state of $V_{OX}L$ continuously lasts longer than the period O, the program proceeds to the point 91 where the F/B execution flag is turned off causing the feedback control responsive to the output from the $O_2$ sensor to be stopped. Namely, according to the processing routine of the points 110 to 113, problems such as a malfunction of the $O_2$ sensor 10 or a disconnection between the $O_2$ sensor and the control circuit 12 are detected so as to stop the feedback control. If $V_{OX} = L$ is discriminated at the point 110, the program proceeds to a point 114 where the input data $V_{OX}$ is compared with a predetermined constant M. If $V_{OX} < M$, the program proceeds to a processing routine of points 115 to 117. In this processing routine of the points 115 to 117, it is discriminated that whether the state of $V_{OX} < M$ continuously lasts longer than a predetermined period P or not. Only when the state of $V_{OX} < M$ continuously lasts longer than the period P, the program proceeds to the point 91 where the F/B execution flag is turned off causing the feedback control to be stopped. Namely, according to the processing routine of the points 114 to 117, problems such as a malfunction of the $O_2$ sensor 10 or a short of the connecting circuit between the $O_2$ sensor 10 and the control circuit 12 are detected so as to stop the feedback control.

Figure 9:
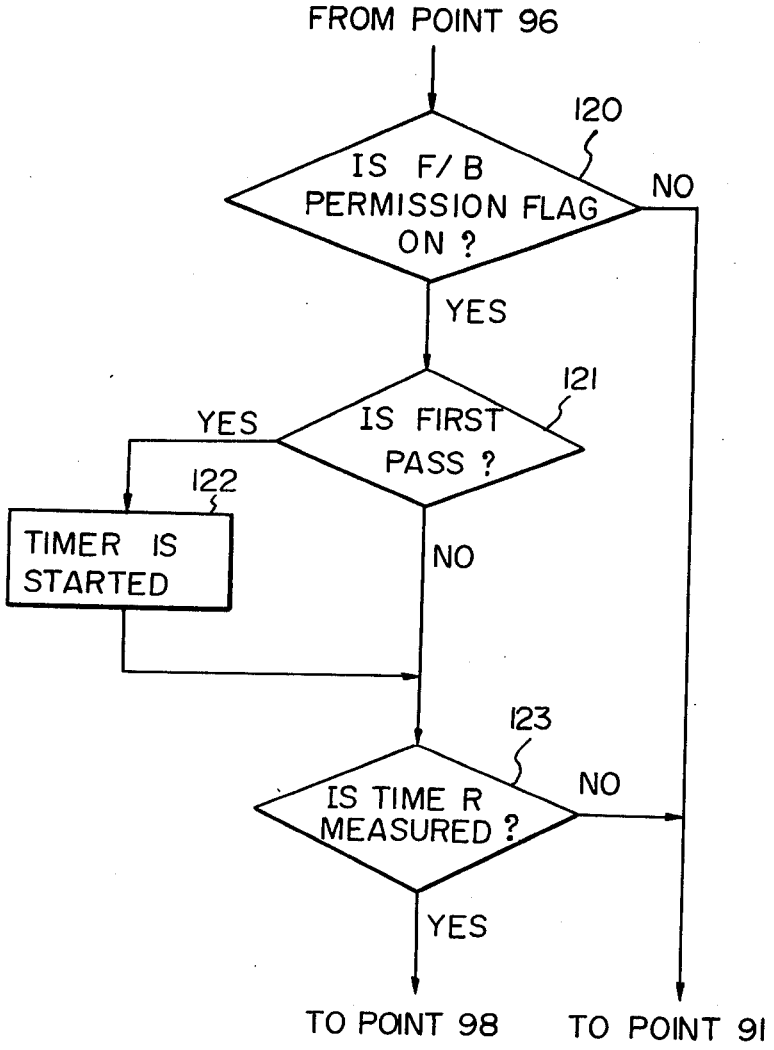

FIG. 9 illustrates a portion of a processing routine according to a still further embodiment of the interruption processing routine shown in FIG. 4. The processing routine of FIG. 9 is executed instead of the points 97 and 99 of FIG. 4. Therefore, other processings of this embodiment are quite the same as those of FIG. 4. After the lapse of time E is measured at the point 96, the program proceeds to a point 120 where the CPU 32 discriminates whether the F/B permission flag controlled at the point 80 or 81 of the main routine is on or not. If the F/B permission flag is off, the program proceeds to the point 91 of FIG. 4 where the F/B execution flag is turned off. Contrary to this if the F/B permission flag is on, the program proceeds to a processing routine of points 121 to 123. In this processing routine of the points 121 to 123, the CPU 32 discriminates whether the state wherein the F/B permission flag is on continuously lasts longer than a predetermined period R of time or not. In other words, whether the state of $V_{MAX} - V_{MIN} \geqq D$ continuously lasts longer than the period R or not is disciminated. Only if it lasts longer than the period R, the program proceeds to the point 98 where the F/B execution flag is turned on causing the feedback control to be executed. According to the above-mentioned processing routine, the feedback control is prevented from executing just after the amplitude of the output voltage of the $O_2$ sensor 10 increases in an instant, but the feedback control is executed after the period R lapses, namely after the output voltage of the $O_2$ sensor is stabilized.

According to the method of the present invention as illustrated in detail in the foregoing, it is possible to certainly and precisely recognize an operative temperature range wherein the $O_2$ sensor is active as whether or not the $O_2$ sensor is active is discriminated in accordance with the amplitude of the $O_2$ sensor's output. Furthermore, since the air-fuel ratio feedback control is executed or stopped in accordance with the amplitude of the $O_2$ sensor, output, the temperature range in which the air-fuel ratio feedback control can be performed is extremely widened.

In addition, according to the present invention, since the reference value $V_R$ is changed in response to the temperature characteristics of the $O_2$ sensor, the temperature range of the air-fuel ratio feedback control is increased, and thus the more precise feedback control can be performed. Furthermore, since these control operations are carried out by an electrical digital computer, the air-fuel ratio can be controlled maintaining increased precision without requiring any additional manufacturing cost.

As many widely different embodiments of the present invention may be constructed without departing from the spirit and scope of the present invention, it should be understood that the present invention is not limited to the specific embodiments described in this specification, except as defined in the appended claims.

We claim:

1. An air-fuel ratio control method of an internal combustion engine having an exhaust gas sensor for detecting the concentration of a predetermined component in the exhaust gas and for generating a voltage signal which represents the detected concentration, and an electrical digital computer, said method comprising the steps of:

monitoring at least one engine condition;

intermittently sampling the voltage signal from said exhaust gas sensor and converting the sampled voltage signal into an electrical signal;

detecting the maximum value and the minimum value of said electrical signal and producing a maximum signal and a minimum signal respectively related thereto by means of said digital computer;

comparing, by means of said digital computer, the magnitude difference between said maximum signal and said minimum signal with a predetermined value to obtain a comparison signal which indicates the comparison result;

determining a fuel feeding rate by means of said digital computer in accordance with said at least one engine condition; and correcting said fuel feeding rate in response to said electrical signal, said correcting being executed when said comparison signal indicates that said magnitude difference is larger than or equal to said predetermined value.

2. Apparatus for controlling the air-fuel ratio in an internal combustion engine comprising:

means for monitoring at least one engine condition;

exhaust gas sensing means for detecting the concentration of a predetermined component in the exhaust gas of said engine and for generating a voltage signal which represents the detected concentration;

means for intermittently sampling the voltage signal from said exhaust gas sensing means and converting the sampled voltage signal into an electrical signal;

electrical digital computer means for: (1) detecting the maximum value and the minimum value of said electrical signal and producing a maximum signal and a minimum signal, respectively related to said maximum value and said minimum value, (2) comparing the magnitude difference between said maximum signal and said minimum signal with a predetermined value to obtain a comparison signal which indicates the comparison result, (3) determining a fuel feeding rate in accordance with said at least one engine condition and (4) correcting said fuel feeding rate in response to said electrical signal, said correcting function being performed when said comparison difference signal indicates that said magnitude difference is larger than or equal to said predetermined value.

3. An air-fuel ratio control method of an internal combustion engine having at least one fuel injection valve, an exhaust gas sensor for detecting the concentration of a predetermined component in the exhaust gas of said engine to produce a voltage signal indicative of the detected concentration, and an electrical digital computer, said method comprising the steps of:

intermittently sampling the voltage signal from said exhaust gas sensor to produce a first electrical signal in the form of a binary number, indicative of the sampled voltage;

detecting the operation of the engine to produce a second electrical signal in the form of a binary number, indicative of the detected operating condition;

finding, by means of said digital computer, the maximum value and the minimum value of said first electrical signal and producing a maximum signal and a minimum signal, respectively related to said maximum value and minimum value;

comparing, by means of said digital computer, the magnitude difference between said maximum signal and said minimum signal with a predetermined value to produce a third electrical signal indicative of the comparison result;

comparing, by means of said digital computer, the value of said first electrical signal with a reference value to produce a fourth electrical signal indicative of the comparison result;

calculating, in response to said second electrical signal, the fuel feeding rate to the engine to produce a fifth electrical signal indicative of the calculated fuel feeding rate, by means of said digital computer;

correcting, by means of said digital computer, the calculated fuel feeding rate indicated by said fifth electrical signal in accordance with said fourth electrical signal to produce a sixth electrical signal indicative of the corrected fuel feeding rate when said third electrical signal indicates that said difference is greater than or equal to said predetermined value, said correcting not being executed and the sixth electrical signal being set equal to said fifth electrical signal when said third electrical signal indicates that said difference is smaller than said predetermined value;

converting said sixth electrical signal into a pulse signal having a variable pulse width which corresponds to said sixth electrical signal; and actuating, in response to said pulse signal, said fuel injection valve.

4. A method as claimed in claim 3, wherein said correcting step is executed when said third electrical signal indicates that said difference is greater than or equal to said predetermined value for a period longer than a predetermined period.

5. A method as claimed in claim 3, wherein said correcting step is executed, irrespective of said difference, when said first electrical signal is greater than an upper threshold.

6. A method as claimed in claim 5, wherein said upper threshold value is determined in accordance with said second electrical signal.

7. A method as claimed in claim 3, wherein said correcting step is not executed when said third electrical signal indicates that said difference is smaller than said predetermined value for a period longer than a predetermined period.

8. A method as claimed in claim 3, wherein said correcting step is not executed when said first electrical signal is greater than an upper threshold value for a period longer than a predetermined period.

9. An air-fuel ratio control apparatus of an internal combustion engine comprising:

at least one fuel injection valve;

exhaust gas sensing means for detecting the concentration of a predetermined component in the exhaust gas of said engine to produce a voltage signal indicative of the detected concentration;

means for intermittently sampling the voltage signal from said exhaust gas sensing means to produce a first electrical signal in the form of a binary number, indicative of the sampled voltage;

means for detecting the operating condition of the engine to produce a second electrical signal in the form of a binary number, indicative of the detected operating condition;

electrical digital computer means for: (1) finding the maximum value and the minimum value of said first electrical signal and producing a maximum signal and a minimum signal, respectively related to said maximum value and minimum value; (2) comparing the magnitude difference between said maximum signal and said minimum signal with a predetermined value to produce a third electrical signal indicative of the comparison result; (3) comparing the value of said first electrical signal with a reference value to produce a fourth electrical signal indicative of the comparison result; (4) calculating, in response to said second electrical signal, the fuel feeding rate to the engine to produce a fifth electrical signal indicative of the calculated fuel feeding rate; and (5) correcting, by means of said digital computer, the calculated fuel feeding rate indicated by said fifth electrical signal in accordance with said fourth electrical signal to produce a sixth electrical signal indicative of the corrected fuel feeding rate when said third electrical signal indicates that said difference is greater than or equal to said predetermined value, said correcting not being executed and the sixth electrical signal being set equal to said fifth electrical signal when said third electrical signal indicates that said difference is smaller than said predetermined value;

means for converting said sixth electrical signal into a pulse signal having a variable pulse width which corresponds to said sixth electrical signal; and means for actuating, in response to said pulse signal, said fuel injection valve.

10. An apparatus as claimed in claim 9, wherein said correcting function is executed only when said third electrical signal indicates that said difference is continuously greater than or equal to said predetermined value for a period longer than a predetermined period.

11. An apparatus as claimed in claim 9, wherein said correcting function is executed, irrespective of said difference, when said first electrical signal is greater than an upper threshold value.

12. An apparatus as claimed in claim 11, wherein said upper threshold value is determined in accordance with said second electrical signal.

13. An apparatus as claimed in claim 9, wherein said correcting function is inhibited from being executed when said third electrical signal indicates that said difference is smaller than said predetermined value for a period longer than a predetermined period.

14. An apparatus as claimed in claim 9, wherein said correcting function is inhibited from being executed when said first electrical signal is greater than an upper threshold value for a period longer than a predetermined period.

* * * * *